US010283892B2

(12) United States Patent
Rangi et al.

(10) Patent No.: US 10,283,892 B2
(45) Date of Patent: May 7, 2019

(54) ELECTRICAL CONNECTOR WITH TOUCH PROTECTION FEATURE

(71) Applicant: Lear Corporation, Southfield, MI (US)

(72) Inventors: Bhupinder Rangi, Novi, MI (US); Yefim Grinshpun, Southfield, MI (US); Anthony Butcher, Troy, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 65 days.

(21) Appl. No.: 15/592,974

(22) Filed: May 11, 2017

(65) Prior Publication Data

US 2018/0331455 A1 Nov. 15, 2018

(51) Int. Cl.

| | |
|---|---|
| ***H01R 13/68*** | (2011.01) |
| ***H01R 13/44*** | (2006.01) |
| ***H01R 24/28*** | (2011.01) |
| ***H01R 24/76*** | (2011.01) |
| ***H01R 13/11*** | (2006.01) |

(52) U.S. Cl.

CPC ..... *H01R 13/44* (2013.01); *H01R 13/11* (2013.01); *H01R 24/28* (2013.01); *H01R 24/76* (2013.01)

(58) Field of Classification Search

CPC ... H01R 13/6456; H01R 31/00; H01R 9/2458

USPC ..... 439/620.34, 682, 949, 76.2, 723

See application file for complete search history.

(56) References Cited

U.S. PATENT DOCUMENTS

| | | | |
|---|---|---|---|
| 6,113,436 A | 9/2000 | Kuwahara et al. | |
| 7,824,210 B2 | 11/2010 | Oka et al. | |
| 8,951,051 B2 | 2/2015 | Natter et al. | |
| 9,634,417 B2 * | 4/2017 | Ramanna ..... | H01R 13/432 |

FOREIGN PATENT DOCUMENTS

| | | |
|---|---|---|
| CN | 103730751 B | 12/2015 |
| JP | 2001266986 A | 9/2001 |

* cited by examiner

*Primary Examiner* — Phuong Chi T Nguyen

(74) *Attorney, Agent, or Firm* — MacMillan, Sobanski & Todd, LLC

(57) ABSTRACT

An electrical connector includes a connector housing with a terminal cavity. The connector housing includes a non-conducting bridge. The non-conducting bridge is located in the terminal cavity.

17 Claims, 6 Drawing Sheets

ELECTRICAL CONNECTOR WITH TOUCH PROTECTION FEATURE

BACKGROUND OF THE INVENTION

The present invention relates in general to an electrical connector with a touch protection feature. More specifically, this invention relates to a touch protection feature that is part of the connector and protects a male electrical terminal installed in the connector from being touched.

Electrical connectors are used to house electrical terminals that are used in a variety of applications, including creating high-voltage and low-voltage connections. Corresponding terminals in corresponding connectors are mated with the electrical terminals. In many instances, it is desirable that a touch protection feature be provided in order to prevent a person from accidentally contacting the electrical terminal.

Touch protection features typically include electrically non-conductive pieces positioned between the electrical terminal and the person. One example of such a touch protection feature for a blade-type male electrical terminal is shown in U.S. Pat. No. 8,951,051, the disclosure of which is incorporated herein by reference. The '051 patent teaches a blade-shaped conductor with a non-conducting end cap secured to the tip. It would be advantageous to have a touch protection feature for a connector that is easier to assemble.

SUMMARY OF THE INVENTION

This invention relates to an electrical connector. The electrical connector includes a connector housing with a terminal cavity. The connector housing includes a non-conducting bridge. The non-conducting bridge is located in the terminal cavity.

In another embodiment, this invention relates to an electrical connector assembly. The electrical connector assembly includes a connector housing with a terminal cavity. A male electrical terminal is located in the terminal cavity. The connector housing includes a non-conducting bridge. The non-conducting bridge is located in the terminal cavity. The electrical connector assembly also includes a corresponding connector housing. The corresponding connector housing includes a female electrical terminal. The female electrical terminal is adapted to mate with the male electrical terminal. The corresponding connector housing includes side walls on opposed sides of the female electrical terminal. Each of the side walls includes a slot. A portion of the non-conducting bridge is located in each slot when the female electrical terminal is engaged with the male electrical terminal.

In another embodiment, this invention relates to an electrical connector assembly. The electrical connector assembly includes a connector housing with a terminal cavity. A male electrical terminal is located in the terminal cavity. The connector housing includes a non-conducting bridge. The non-conducting bridge is located in the terminal cavity. The electrical connector assembly also includes a corresponding connector housing. The corresponding connector housing includes a female electrical terminal. The female electrical terminal is mated with the male electrical terminal. The corresponding connector housing includes side walls on opposed sides of the female electrical terminal. At least a portion of each of the side walls is located in the terminal cavity. Each of the side walls includes a slot. At least a portion of the non-conducting bridge located in each of the slots.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
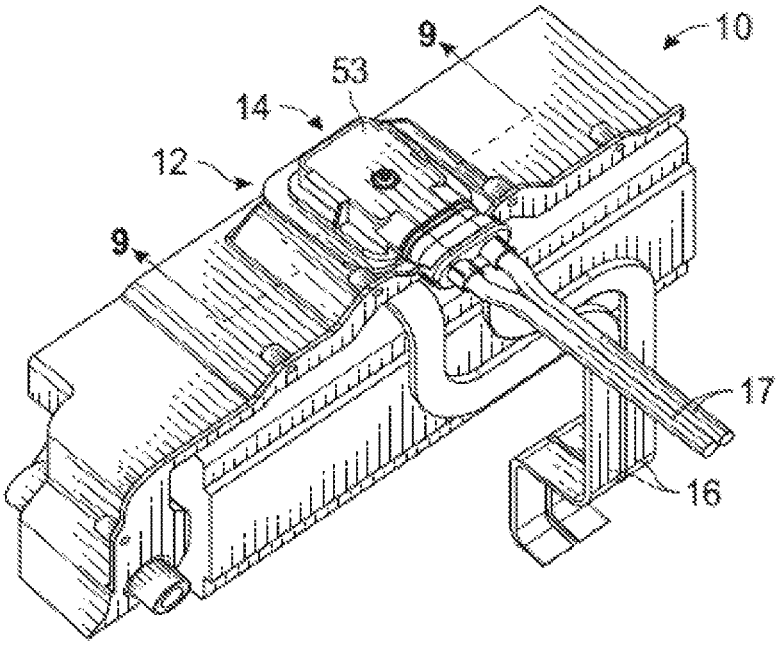
FIG. 1 is a perspective view of an electrical connection assembly.

Referring now to the drawings, there is illustrated in FIG. 1 an electrical connection assembly, indicated generally at 10. The electrical connection assembly 10 includes a mounted connector, indicated generally at 12, and a corresponding connector, indicated generally at 14. The electrical connection assembly 10 allows two busbars 16, which are connected to the mounted connector 12, to be selectively connected to two wires 17, which are connected to the corresponding connector 14. The illustrated electrical connection assembly 10 is an example of one electrical connector which the invention described herein can be used with. However, the invention may be used with any desired electrical connector.

Figure 2:
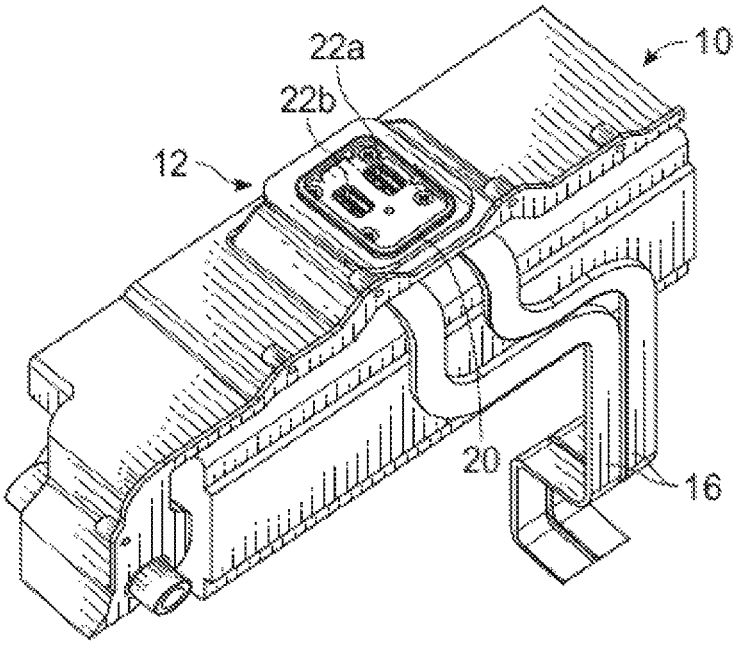
FIG. 2 is a perspective view similar to FIG. 1, shown with a corresponding connector housing removed so that a mounted connector housing with two male terminal cavities is visible.
Figure 3:
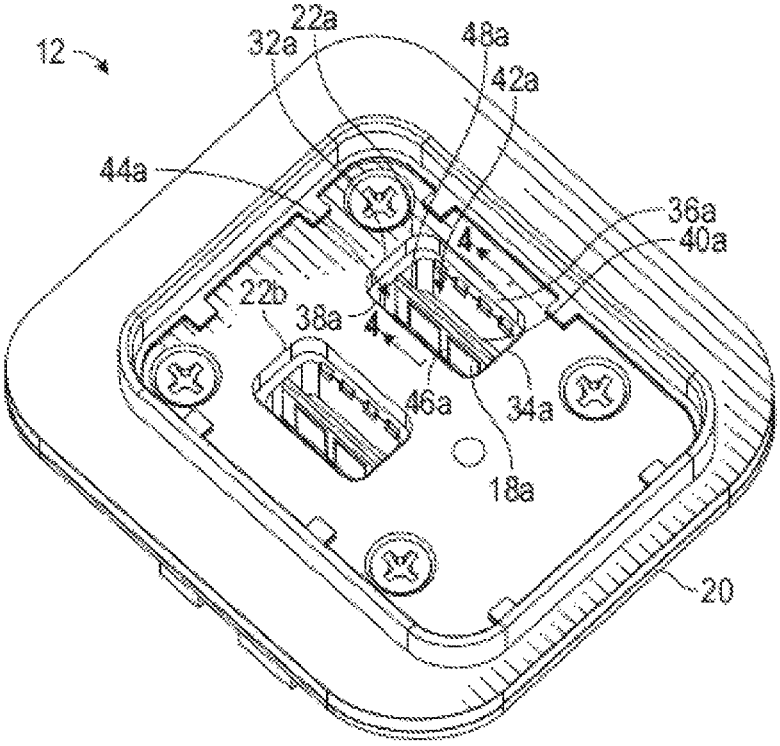
FIG. 3 is an enlarged view of the mounted connector housing.
Figure 4:
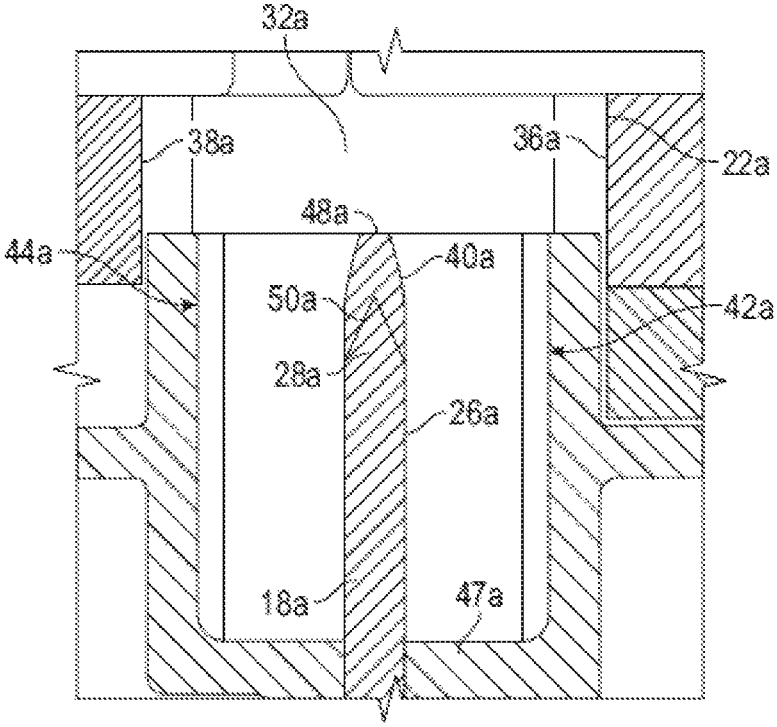
FIG. 4 is a further enlarged, cross-sectional view of one terminal cavity of the mounted connector housing, taken along line 4-4 of FIG. 3.
Figure 5:
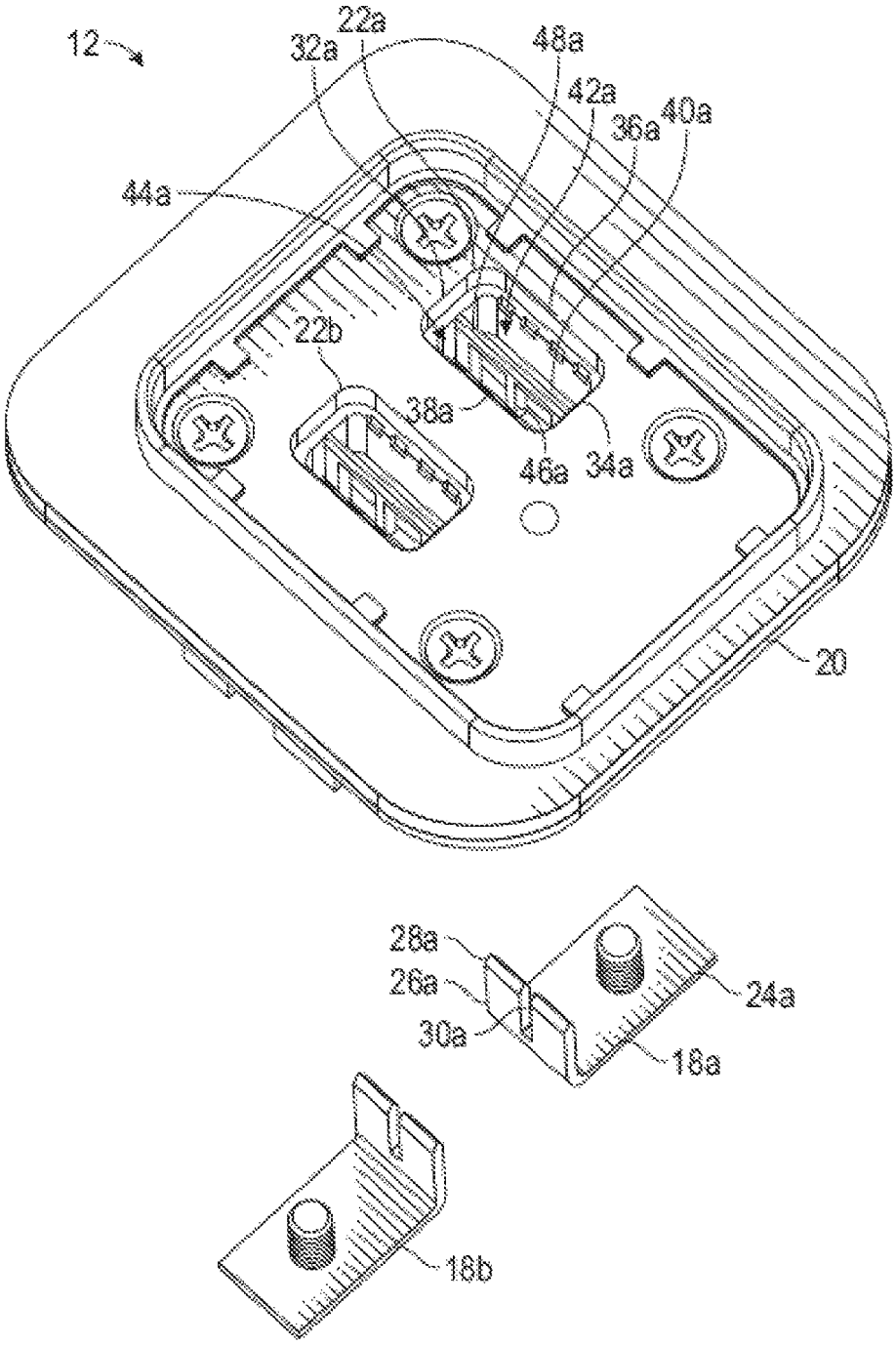
FIG. 5 is a perspective, partially exploded view of the mounted connector housing and two male blade terminals illustrated in FIG. 3.

Referring now to FIG. 2, a view similar to that of FIG. 1 is illustrated, showing the electrical connection assembly 10 with the corresponding connector 14 removed so that the mounted connector 12 is more clearly visible. The mounted connector 12 will be described primarily in reference to FIGS. 3 through 5. Referring to FIG. 3, an enlarged view of the mounted connector 12 is shown, removed from the rest of the electrical connection assembly 10. FIG. 4 is a cross-sectional view taken through a portion of the mounted connector 12. FIG. 5 shows a partially-exploded view of the mounted connector 12, with two male terminals 18*a* and 18*b* removed from a connector housing 20.

The illustrated connector housing 20 is made of plastic, but may be made of any desired material. The connector housing 20 includes two terminal cavities 22*a* and 22*b*, but may include any desired number of terminal cavities. The two terminal cavities 22*a* and 22*b* are substantially the same, and only the terminal cavity 22*a* will be described in detail. Similarly, the two male terminals 18*a* and 18*b* are substantially the same, and only the male terminal 18*a* will be described in detail.

The male terminal 18*a* is made from a single piece of sheet copper, but may be made of any desired material using any desired manufacturing process. The male terminal 18*a* includes a connection portion 24*a* and a contact portion 26*a*. The illustrated connection portion 24*a* is adapted to be connected to one of the busbars 16 using a threaded connector. However, the connection portion 24*a* may be any desired type of connector. The illustrated contact portion 26*a* is a blade-type terminal, but may have any desired shaped. The illustrated male terminal is 18*a* generally L-shaped, with the contact portion 26*a* bent substantially perpendicular to the connection portion 24*a*. However, the male terminal 18*a* may have any desired shaped. The contact portion 26*a* extends from the connection portion 24*a* to an outer end 28*a*. The illustrated outer end 28*a* tapers to a point, but the outer end 28*a* may have any desired shape. The contact portion 26*a* includes an optional slot 30*a*. The slot 30*a* extends from the outer end 28*a* toward the connection portion 24*a*. The purpose of the slot 30*a* will be described below.

The illustrated terminal cavity 22*a* is defined in the connector housing 20 and has a generally rectangular cross-sectional shape, but may have any desired cross-sectional shape. The terminal cavity 22*a* includes a first two opposed side walls 32*a* and 34*a*, and a second two opposed side walls 36*a* and 38*a*. The terminal cavity 22*a* includes a non-conducting bridge 40*a* that is connected to the connector housing 20. The illustrated non-conducting bridge 40*a* extends from the side wall 32*a* to the opposed side wall 34*a*. The illustrated non-conducting bridge 40*a* is made of plastic and is molded as a part of the connector housing 20. However, the non-conducting bridge 40*a* may be made of any desired material and by any desired process. The non-conducting bridge 40*a* may be a separate piece that is connected to the connector housing 20, if desired. A first opening, indicated at 42*a*, is defined between the non-conducting bridge 40*a* and the side wall 36*a*, and a second opening, indicated at 44*a*, is defined between the non-conducting bridge 40*a* and the opposed side wall 38*a*.

As best seen in FIG. 5, the connector housing 20 includes an optional strut 46*a* which extends from the non-conducting bridge 40*a* to a bottom 47*a* of the terminal cavity 22*a*. The illustrated strut 46*a* is made of plastic and is molded as a part of the connector housing 20. However, the strut 46*a* may be made of any desired material and by any desired process. The strut 46*a* provides support for the non-conducting bridge 40*a* prior to the male terminal 18*a* being installed in the terminal cavity 22*a*. In the event that pressure is applied to the non-conducting bridge 40*a* during assembly, the strut 46*a* can support the load to help prevent damage to the non-conducting bridge 40*a*. When the male terminal 18*a* is installed in the terminal cavity 22*a*, the strut 46*a* is located in the slot 30*a* of the male terminal 18*a*, as shown in FIG. 3. The illustrated connector housing 20 includes a single strut 46*a*, but may include any desired number of struts.

As best seen in FIG. 4, the non-conducting bridge 40*a* includes an outer bridge end 48*a*. The illustrated outer bridge end 48*a* tapers to a point, but the outer bridge end 48*a* may have any desired shape. The non-conducting bridge 40*a* also includes a recess 50*a* on the opposed side of the non-conducting bridge 40*a*. The illustrated recess 50*a* has a V-shape, but may have any desired shape. When the illustrated male terminal 18*a* is installed in the connector housing 20, it is inserted into the terminal cavity 22*a*, as shown in FIG. 3. The outer end 28*a* of the contact portion 26*a* enters the recess 50*a* in the non-conducting bridge 40*a* in order to assist in the proper alignment of the contact portion 26*a* with the non-conducting bridge 40*a*.

Referring back to FIG. 3, it can be seen that the non-conducting bridge 40*a* provides a touch protection feature for the mounted connector 12. The male terminal 18*a* may be contacted by an object small enough to fit through the first opening 42*a* or the second opening 44*a*, but larger objects are prevented from contacting the male terminal 18*a*. The sizes of the opening 42*a* and the opening 44*a* may be selected to exclude objects of any desired size. The illustrated non-conducting bridge 40*a* is made of a non-electrically conductive material. However, the non-conducting bridge 40*a* may be made of any desired material and may, for example, include a non-conducting layer or coating.

Figure 6:
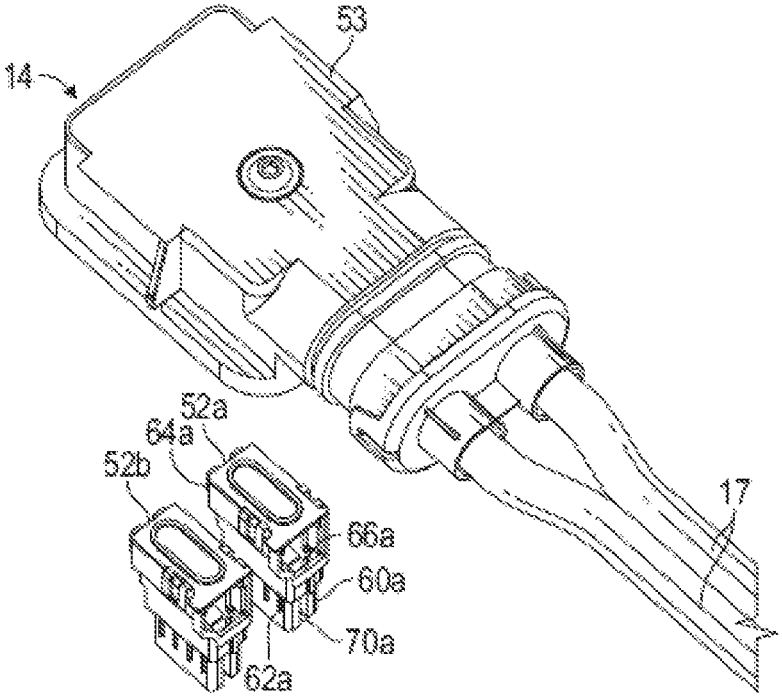
FIG. 6 is an enlarged, perspective, exploded view of the corresponding connector housing and two female terminal housings illustrated in FIG. 1.
Figure 7:
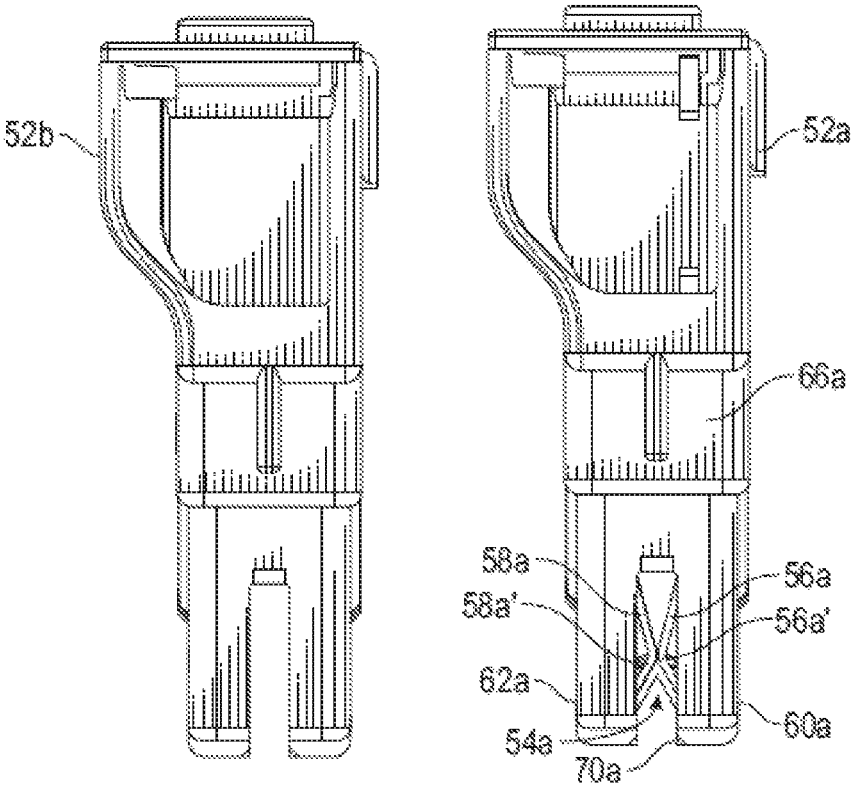
FIG. 7 is a side view of the two female terminal housings illustrated in FIG. 6.
Figure 8:
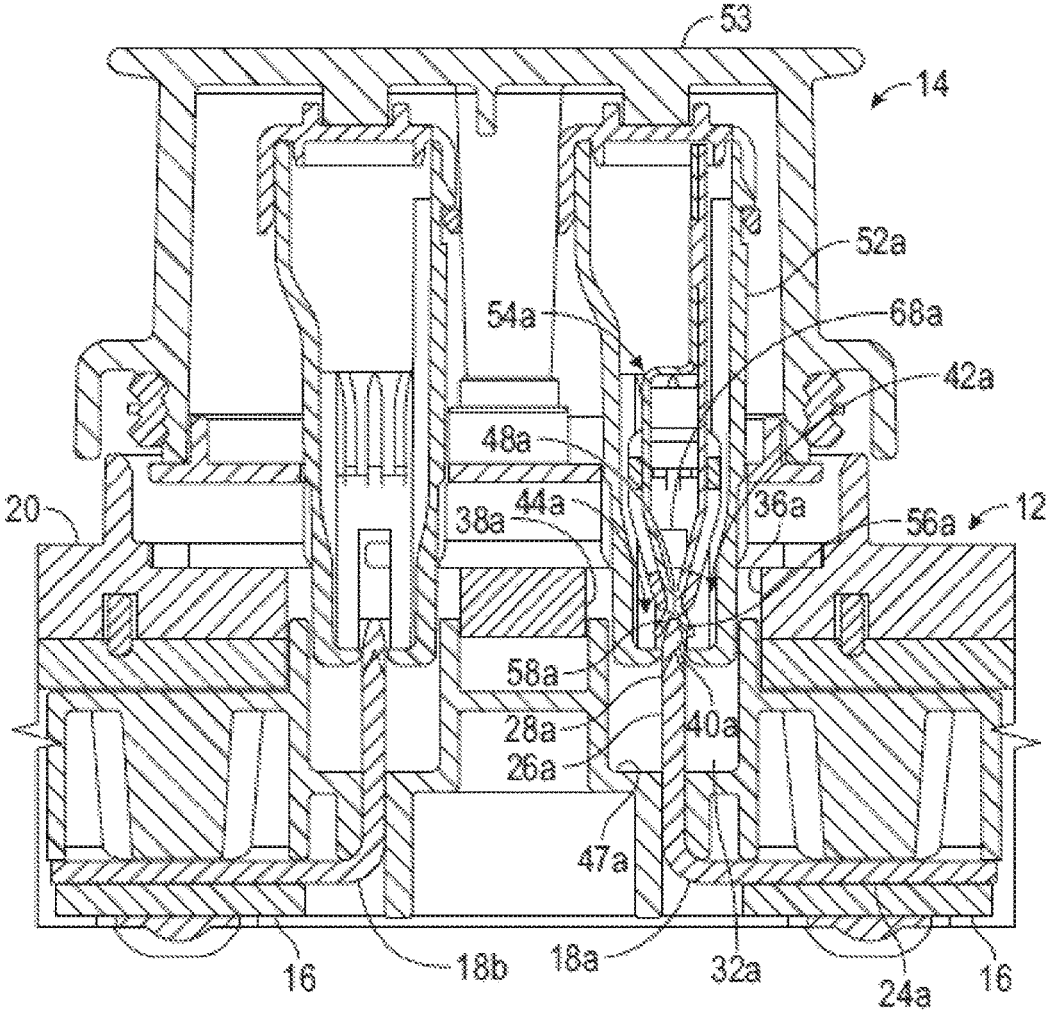
FIG. 8 is a cross-sectional view of the electrical connection assembly shown during connection of the corresponding connector housing to the mounted connector housing.
Figure 9:
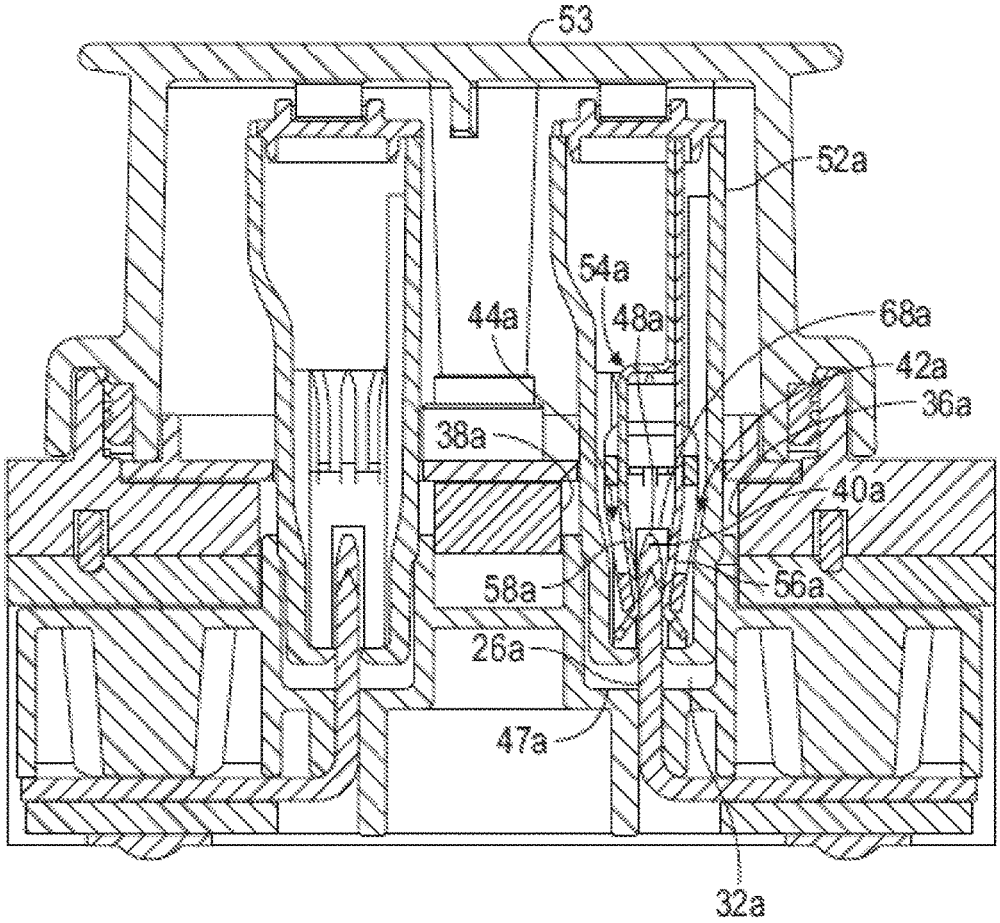
FIG. 9 is a cross-sectional view of the electrical connection assembly, taken along line 9-9 of FIG. 1, showing the final connection position of the corresponding connector housing to the mounted connector housing.

Referring now to FIG. 6, a perspective view of the corresponding connector 14 is shown, partially-exploded with two female terminal housings 52*a* and 52*b* shown removed from a corresponding connector housing 53. The female terminal housings 52*a* and 52*b* will be described primarily in reference to FIGS. 6 through 9. Referring to FIG. 7, a side view of the two female terminal housings 52*a* and 52*b* is shown. The two female terminal housings 52*a* and 52*b* are substantially the same, and only the female terminal housing 52*a* will be described in detail. The female terminal housing 52*a* is shown with a female terminal, indicated generally at 54*a*, mounted therein. The female terminal housing 52*b* is shown without a female terminal, so that features of the female terminal housing 52*b* are more easily visible. Referring to FIG. 8, a cross-sectional view of the electrical connection assembly 10 is illustrated, shown during initial connection of the assembled corresponding connector 14 to the mounted connector 12.

The female terminal 54*a* includes opposed contact arms 56*a* and 58*a*, which are adapted to engage the male blade terminal 18*a*. The contact arms 56*a* and 58*a* include respective contact areas, 56*a*' and 58*a*', which will contact the male terminal 18*a*. In the illustrated embodiment, the contact areas 56*a*' and 58*a*' are initially in contact with each other. However, the contact areas 56*a*' and 58*a*' may be spaced apart with a gap therebetween, if desired. The contact arms 56*a* and 58*a* will spread apart when engaged by a male blade terminal, as is well known in the art. The contact arms 56*a* and 58*a* will spread apart toward respective, opposed side walls 60*a* and 62*a* of the female terminal housing 52*a*. The female terminal housing 52 also includes opposed sides walls 64*a* and 66*a*, which are generally perpendicular to opposed side walls 60*a* and 62*a*. The opposed side walls 64*a* and 66*a* include respective slots 68*a* and 70*a*. The slots 68*a* and 70*a* define a space therebetween, and the contact areas, 56*a*' and 58*a*' are located in this space between the slots 68*a* and 70*a*. This is best shown in FIG. 7, where the contact areas 56*a*' and 58*a*' are visible through the slot 70*a* when viewed perpendicularly to the side wall 66*a*.

As shown in FIG. 8, during initial connection of the corresponding connector 14 to the mounted connector 12, the non-conducting bridge 40*a* passes through the slots 68*a* and 70*a* and engages the contact arms 56*a* and 58*a*. As the corresponding connector 14 is moved farther toward the mounted connector 12, the contact arms 56*a* and 58*a* will be spread apart by the non-conducting bridge 40*a* and will pass through the first and second openings 42*a* and 44*a*. The contact arms 56*a* and 58*a* will slide along the non-conducting bridge 40*a* until they engage the male terminal 18*a*. The female terminal 54*a* will then be in electrical contact with the male terminal 18*a*. As previously described, the outer end 28*a* of the contact portion 26*a* is positioned in the recess 50*a* in the non-conducting bridge 40*a* in order to assist in the proper alignment of the contact portion 26*a* with the non-conducting bridge 40*a*. This helps to ensure that the contact arms 56*a* and 58*a* can smoothly slide from the non-conducting bridge 40*a* onto the male terminal 18*a* without damaging any of the components.

The principle and mode of operation of this invention have been explained and illustrated in its preferred embodiment. However, it must be understood that this invention may be practiced otherwise than as specifically explained and illustrated without departing from its spirit or scope.

What is claimed is:

1. An electrical connector comprising:

a connector housing including a terminal cavity having an opened end and a bottom;

an electrical terminal disposed within the terminal cavity and extending from the bottom to an outer end located adjacent to the opened end; and a non-conducting bridge connected to the connector housing and extending across the opened end of the terminal cavity adjacent to the outer end of the terminal to prevent contact with the electrical terminal from the opened end.

2. The electrical connector of claim 1, wherein the electrical terminal located in the terminal cavity is a male electrical terminal.

3. The electrical connector of claim 1, wherein the non-conducting bridge extends between two opposed side walls of the terminal cavity.

4. The electrical connector of claim 3, wherein first and second openings are defined between the non-conducting bridge and a second two opposed side walls of the terminal cavity.

5. The electrical connector of claim 1, further including a strut that extends from the non-conducting bridge to the bottom of the terminal cavity.

6. The electrical connector of claim 5, wherein the electrical terminal includes a slot, and wherein the strut is located in the slot.

7. The electrical connector of claim 1, wherein the non-conducting bridge includes a recess, and wherein the outer end of the electrical terminal is located in the recess.

8. The electrical connector of claim 7, wherein the outer end of the electrical terminal tapers to a point.

9. The electrical connector of claim 8, further including a strut that extends from the non-conducting bridge to the bottom of the terminal cavity.

10. The electrical connector of claim 9, wherein the electrical terminal includes a slot, and wherein the strut is located in the slot.

11. An electrical connector assembly comprising:

a connector housing including a terminal cavity having an opened end and a bottom;

a male electrical terminal located in the terminal cavity and extending from the bottom to an outer end located adjacent to the opened end;

a non-conducting bridge connected to the connector housing and extending across the opened end of the terminal cavity adjacent to the outer end of the terminal to prevent contact with the electrical terminal from the opened end; and a corresponding connector housing including a female electrical terminal that is mated with the male electrical terminal, wherein the corresponding connector housing includes side walls on opposed sides of the female electrical terminal, each of the side walls includes a respective slot, and a portion of the non-conducting bridge is located in each of the slots.

12. The electrical connector assembly of claim 11, wherein the non-conducting bridge extends between two opposed side walls of the terminal cavity.

13. The electrical connector assembly of claim 12, wherein the non-conducting bridge includes a recess, and wherein the outer end of the male electrical terminal is located in the recess.

14. The electrical connector assembly of claim 13, wherein the outer end of the male electrical terminal tapers to a point.

15. The electrical connector assembly of claim 14, further including a strut that extends from the non-conducting bridge to the bottom of the terminal cavity.

16. The electrical connector assembly of claim 15, wherein the male electrical terminal includes a slot, and wherein the strut is located in the slot.

17. An electrical connector assembly comprising:

a connector housing including a terminal cavity having an opened end and a bottom;

a male electrical terminal located in the terminal cavity and extending from the bottom to an outer end located adjacent to the opened end;

a non-conducting bridge connected to the connector housing and extending across the opened end of the terminal cavity adjacent to the outer end of the terminal to prevent contact with the electrical terminal from the opened end; and a corresponding connector housing including a female electrical terminal that is mated with the male electrical terminal, wherein the corresponding connector housing includes side walls on opposed sides of the female electrical terminal, at least a portion of each of the side walls is located in the terminal cavity, each of the side walls includes a respective slot, and at least a portion of the non-conducting bridge located is in each of the slots.

* * * * *